US011390929B2

(12) United States Patent
Yoo et al.

(10) Patent No.: US 11,390,929 B2
(45) Date of Patent: Jul. 19, 2022

(54) HOT-STAMPED PART AND METHOD FOR MANUFACTURING SAME

(71) Applicant: Hyundai Steel Company, Incheon (KR)

(72) Inventors: Byung Gil Yoo, Seoul (KR); Hyeong Hyeop Do, Chungcheongnam-do (KR); Chee Woong Song, Seoul (KR); Hee Joong Lim, Gyeonggi-do (KR); Sung Yul Huh, Gyeonggi-do (KR)

(73) Assignee: Hyundai Steel Company, Incheon (KR)

( * ) Notice: Subject to any disclaimer, the term of this patent is extended or adjusted under 35 U.S.C. 154(b) by 212 days.

(21) Appl. No.: 16/625,470

(22) PCT Filed: Dec. 29, 2017

(86) PCT No.: PCT/KR2017/015715
§ 371 (c)(1),
(2) Date: Dec. 20, 2019

(87) PCT Pub. No.: WO2019/004540
PCT Pub. Date: Jan. 3, 2019

(65) Prior Publication Data

US 2021/0147955 A1 May 20, 2021

(30) Foreign Application Priority Data

Jun. 27, 2017 (KR) ..... 10-2017-0081281
Dec. 8, 2017 (KR) ..... 10-2017-0168404

(51) Int. Cl.
*C21D 9/00* (2006.01)
*B21D 22/02* (2006.01)
(Continued)

(52) U.S. Cl.
CPC ..... *C21D 9/0081* (2013.01); *B21D 22/022* (2013.01); *C21D 8/0205* (2013.01);
(Continued)

(58) Field of Classification Search
CPC ..... B21D 22/022; B21D 53/88; C21D 1/18; C21D 1/185; C21D 1/26; C21D 1/28;
(Continued)

(56) References Cited

U.S. PATENT DOCUMENTS

2015/0125716 A1* 5/2015 Kojima ..... C23C 2/405 428/659

FOREIGN PATENT DOCUMENTS

CN 103261452 A 8/2013
CN 104195443 A * 12/2014
(Continued)

OTHER PUBLICATIONS

Liu et al., "Oxidation, Decarburization and Decarburization Annealing", Heat treatment process, Metallurgical Industry Press, 1st edition, Aug. 31, 2015, 6 pages (2 pages in English & 4 pages in Foreign language).

*Primary Examiner* — Jenny R Wu
(74) *Attorney, Agent, or Firm* — Fox Rothschild LLP

(57) ABSTRACT

A method for manufacturing a hot-stamped part includes reheating a steel slab at a temperature of 1,200° C. to 1,250° C., the steel slab including, by wt %, 0.20 to 0.50% carbon (C), 0.05 to 1.00% silicon (Si), 0.10 to 2.50% manganese (Mn), more than 0% and not more than 0.015% phosphorus (P), more than 0% and not more than 0.005% sulfur (S), 0.05 to 1.00% chromium (Cr), 0.001 to 0.009% boron (B), 0.01 to 0.09% titanium (Ti), and a balance of iron (Fe) and inevitable impurities; finish-rolling the reheated steel slab at a temperature of 880° C. to 950° C.; cooling the hot-rolled steel plate without using water, and coiling the cooled steel
(Continued)

plate at a temperature of 680° C. to 800° C. to form a hot-rolled decarburized layer on a surface of the steel plate; pickling the coiled steel plate, followed by cold rolling; annealing the cold-rolled steel plate in a reducing atmosphere; plating the annealed steel plate; and hot-stamping the plated steel plate.

7 Claims, 6 Drawing Sheets

(51) Int. Cl.

| | |
|---|---|
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/44*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |

(52) U.S. Cl.
CPC ..... *C21D 8/0226* (2013.01); *C21D 8/0236* (2013.01); *C21D 9/46* (2013.01); *C22C 38/002* (2013.01); *C22C 38/02* (2013.01); *C22C 38/44* (2013.01); *C22C 38/48* (2013.01); *C22C 38/50* (2013.01); *C22C 38/54* (2013.01); *C22C 38/58* (2013.01); *C21D 2211/002* (2013.01); *C21D 2211/005* (2013.01); *C21D 2211/008* (2013.01)

(58) Field of Classification Search
CPC .... C21D 1/673; C21D 1/76; C21D 2211/002; C21D 2211/005; C21D 2211/008; C21D 3/04; C21D 6/005; C21D 6/008; C21D 7/13; C21D 8/0205; C21D 8/0226; C21D 8/0236; C21D 8/0426; C21D 8/0436; C21D 8/0457; C21D 8/0463; C21D 9/0081; C21D 9/46; C22C 38/002; C22C 38/02; C22C 38/04; C22C 38/28; C22C 38/32; C22C 38/38; C22C 38/44; C22C 38/48; C22C 38/50; C22C 38/54; C22C 38/58
See application file for complete search history.

(56) References Cited

FOREIGN PATENT DOCUMENTS

| | | | |
|---|---|---|---|
| CN | 104195443 | A | 12/2014 |
| CN | 104271789 | A | 1/2015 |
| CN | 105492134 | A | 4/2016 |
| CN | 103687973 | B | 8/2016 |
| CN | 105849298 | A | 8/2016 |
| CN | 106756697 | A | 5/2017 |
| EP | 2 631 308 | A1 | 8/2013 |
| JP | 2007031761 | A | 2/2007 |
| KR | 10-0851805 | B1 | 8/2008 |
| KR | 1020090071177 | A | 7/2009 |
| KR | 10-2011-0118621 | A | 10/2011 |
| KR | 10-2015-0038959 | A | 4/2015 |
| KR | 10-1568549 | B1 | 11/2015 |
| KR | 10-2016-0032194 | A | 3/2016 |

* cited by examiner

HOT-STAMPED PART AND METHOD FOR MANUFACTURING SAME

CROSS-REFERENCE TO RELATED APPLICATIONS

This application is a National Phase application filed under 35 USC 371 of PCT International Application No. PCT/KR2017/015715 with an International Filing Date of Dec. 29, 2017, which claims under 35 USC 119(a) the benefit of Korean Application No. 10-2017-0081281, filed Jun. 27, 2017, and Korean Application No. 10-2017-0168404, filed Dec. 8, 2017, the entire contents of which are incorporated herein.

TECHNICAL FIELD

The present disclosure relates to a hot-stamped part and a method for manufacturing the same.

BACKGROUND ART

A B-pillar, a critical component for an automotive crash energy absorber, is mainly made of a heat-treated steel corresponding to a class of 150K or higher. It plays a very important role in assuring a survival space for the driver when a side crash occurs. In addition, a high-toughness steel member which is used as a crash energy absorber undergoes brittle fracture which threatens the safety of the driver, when a side crash occurs. For this reason, a low-toughness steel member is connected to the lower end of the B-pillar, which undergoes brittle fracture, thereby increasing the crash energy absorption ability of the B-pillar. This steel member is referred to as a steel plate for Taylor-Welded Blank (TWB) applications. The steel plate for TWB applications is produced by a hot-rolling process and a cold-rolling process, followed by a hot-press process such as hot stamping.

The prior art related to the present disclosure is disclosed in Korean Patent No. 1304621 (published on Aug. 6, 2008; entitled "Method for Manufacturing High-Carbon Steel Plate Having Excellent Impact Toughness").

SUMMARY OF THE INVENTION

Technical Problem

One embodiment of the present disclosure provides a hot-stamped part having excellent crash performance and a method for manufacturing the same.

One embodiment of the present disclosure provides a hot-stamped part having excellent mechanical properties, such as bending properties and high strength-toughness, and a method for manufacturing the same.

Technical Solution

The method for manufacturing the hot-stamped part includes the steps of: reheating a steel slab at a temperature of 1,200° C. to 1,250° C., the steel slab including, by wt %, 0.20 to 0.50% carbon (C), 0.05 to 1.00% silicon (Si), 0.10 to 2.50% manganese (Mn), more than 0% and not more than 0.015% phosphorus (P), more than 0% and not more than 0.005% sulfur (S), 0.05 to 1.00% chromium (Cr), 0.001 to 0.009% boron (B), 0.01 to 0.09% titanium (Ti), and the balance of iron (Fe) and inevitable impurities; finish-rolling the reheated slab at a temperature of 880° C. to 950° C.; cooling the hot-rolled steel plate without using water, and coiling the cooled steel plate at a temperature of 680° C. to 800° C. to form a hot-rolled decarburized layer on the surface of the steel plate; pickling the coiled steel plate, followed by cold rolling; annealing the cold-rolled steel plate in a reducing atmosphere; plating the annealed steel plate; and hot-stamping the plated steel plate.

In one embodiment, the slab may further include one or more of 0.01 to 0.80 wt % molybdenum (Mo) and 0.01 to 0.09 wt % niobium (Nb).

In one embodiment, the hot-rolled decarburized layer may be formed to have a thickness of 10 to 50 μm from the surface after the coiling.

In one embodiment, the hot-rolled decarburized layer may have a thickness of 5 to 15 μm from the surface after the hot stamping.

In one embodiment, the microstructure of the hot-rolled decarburized layer may have a mixed structure composed of ferrite, bainite and martensite, after the hot stamping.

In one embodiment, the annealing may be performed at a dew point of −15° C. or below in a gas atmosphere composed of hydrogen and the balance of nitrogen.

Disclosed is a hot-stamped part according to another aspect of the present disclosure. The hot-stamped part includes a steel having a composition containing, by wt %, 0.20 to 0.50% carbon (C), 0.05 to 1.00% silicon (Si), 0.10 to 2.50% manganese (Mn), more than 0% and not more than 0.015% phosphorus (P), more than 0% and not more than 0.005% sulfur (S), 0.05 to 1.00% chromium (Cr), 0.001 to 0.009% boron (B), 0.01 to 0.09% titanium (Ti), and the balance of iron (Fe) and inevitable impurities, has a surface decarburized layer formed to a thickness of 5 to 15 μm from the surface of the steel, and has a tensile strength (TS) of 1,400 MPa or greater, a yield strength (YS) of 1,000 MPa or greater, and an elongation (EL) of 7% or greater.

In one embodiment, the microstructure of the hot-rolled decarburized layer may have a mixed structure composed of ferrite, bainite and martensite.

Advantageous Effects

According to one embodiment of the present disclosure, it is possible to obtain a hot-stamped part having excellent mechanical properties, such as crash performance, bending properties and high strength-toughness.

According to one embodiment of the present disclosure, it is possible to provide a method for manufacturing the above-described hot-stamped part having excellent mechanical properties.

DETAILED DESCRIPTION

Mode for Disclosure

Hereinafter, the present disclosure will be described in detail. In the following description of the present disclosure, when it is considered that the detailed description of the related known technology or configuration may unnecessarily obscure the subject matter of the present invention, the detailed description will be omitted.

The terms described below are terms defined in consideration of functions in the present invention, and may vary depending on a user's or operator's intention or practice. Accordingly, the definitions of these terms should be made based on the contents throughout the present specification that describes the present disclosure.

In the present specification, the term "hot-rolled decarburized layer" refers to a decarburized layer formed in a steel through a hot-rolling process including hot rolling, cooling and coiling steps. The hot-rolled decarburized layer may remain in the steel even after a cold-cooling process has been completed. For example, after cold rolling, annealing, plating and hot-stamping processes, the hot-rolled decarburized layer may remain on the surface of the steel, and bainite and ferrite phases may be formed in the hot-rolled decarburized layer, thereby improving the bending performance of the steel. The improved bending performance may improve the crash performance of the hot-stamped product.

Method for Manufacturing Hot-Stamped Part

Figure 1:
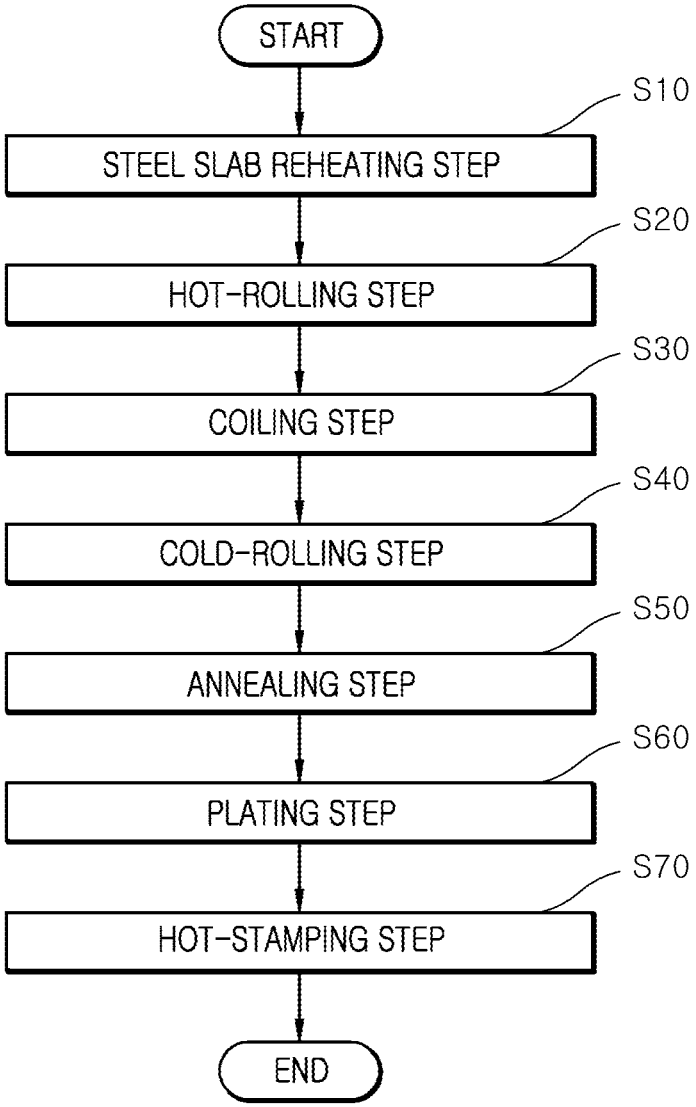
FIG. 1 is a flow chart schematically illustrating a method for manufacturing a hot-stamped part according to one embodiment of the present disclosure.

One embodiment of the present disclosure relates to a method for manufacturing a hot-stamped part. FIG. 1 is a flow chart schematically illustrating a method for manufacturing a hot-stamped part according to one embodiment of the present disclosure. Referring to FIG. 1, the method for manufacturing a hot-stamped part includes a steel slab-reheating step (S10), a hot-rolling step (S20), a coiling step (S30), a cold-rolling step (S40), an annealing step (S50), a plating step (S60), and a hot-stamping step (S70).

More specifically, the method for manufacturing a hot-stamped part includes the steps of: (S10) reheating a steel slab at a temperature of 1,200° C. to 1,250° C., the steel slab including, by wt %, 0.20 to 0.50% carbon (C), 0.05 to 1.00% silicon (Si), 0.10 to 2.50% manganese (Mn), more than 0% and not more than 0.015% phosphorus (P), more than 0% and not more than 0.005% sulfur (S), 0.05 to 1.00% chromium (Cr), 0.001 to 0.009% boron (B), 0.01 to 0.09% titanium (Ti), and the balance of iron (Fe) and inevitable impurities; (S20) finish-rolling the reheated steel slab at a temperature of 880° C. to 950° C.; (S30) cooling the hot-rolled steel plate without using water, and coiling the cooled steel plate at a temperature of 680° C. to 800° C. to form a hot-rolled decarburized layer on the surface of the steel plate; (S40) pickling the coiled steel plate, followed by cold rolling; (S50) annealing the cold-rolled steel plate in a reducing atmosphere; (S60) plating the annealed steel plate; and (S70) hot-stamping the plated steel plate.

In some embodiments, the steel slab may further include one or more of 0.01 to 0.80 wt % molybdenum (Mo) and 0.01 to 0.09 wt % niobium (Nb).

Hereinafter, each step of the method for manufacturing a hot-stamped part according to the present disclosure will be described in detail.

(S10) Steel Slab-Reheating Step

This step is a step of reheating a steel slab at a temperature of 1,200° C. to 1,250° C., the steel slab containing, by wt %, 0.20 to 0.50% carbon (C), 0.05 to 1.00% silicon (Si), 0.10 to 2.50% manganese (Mn), more than 0% and not more than 0.015% phosphorus (P), more than 0% and not more than 0.005% sulfur (S), 0.05 to 1.00% chromium (Cr), 0.001 to 0.009% boron (B), 0.01 to 0.09% titanium (Ti), and the balance of iron (Fe) and inevitable impurities.

In some embodiments, the steel slab may further contain one or more of 0.01 to 0.80 wt % molybdenum (Mo) and 0.01 to 0.09 wt % niobium (Nb).

Hereinafter, the functions and contents of the components contained in the steel slab will be described in detail.

Carbon (C)

Carbon (C) is a major element that determines the strength and hardness of the steel, and is included to ensure the tensile strength of the steel after the hot-stamping (hot-pressing) process.

In one embodiment, carbon is contained in an amount of 0.20 to 0.50 wt % based on the total weight of the steel slab. When carbon is contained in an amount of less than 0.20 wt %, it may be difficult to achieve the mechanical strength of the present invention, and when carbon is contained in an amount of more than 0.50 wt %, a problem may arise in that the toughness of the steel is decreased or it is difficult to control the brittleness of the steel.

Silicon (Si)

Silicon (Si) acts as a ferrite stabilizing element in the steel plate. It may function to improve the ductility of the steel by making ferrite clean and to increase the concentration of carbon in austenite by suppressing carbide formation in a low-temperature region.

In one embodiment, silicon is contained in an amount of 0.05 to 1.00 wt % based on the total weight of the steel slab. When silicon is contained in an amount of less than 0.05 wt %, it cannot sufficiently exhibit the above-described functions, and when silicon is contained in an amount of more than 1.00 wt %, the weldability of the steel plate may be decreased.

Manganese (Mn)

Manganese (Mn) is included for the purpose of increasing hardenability and strength during heat treatment.

In one embodiment, manganese is contained in an amount of 0.10 to 2.50 wt % based on the total weight of the steel slab. When manganese is contained in an amount of less than 0.10 wt %, the hardenability and strength of the steel may be decreased, and when manganese is contained in an amount of more than 2.50 wt %, the ductility and toughness of the steel may be reduced due to manganese segregation.

Phosphorus (P)

Phosphorus (P) is an element that is easily segregated and degrades the toughness of the steel. In one embodiment, phosphorus (P) is contained in an amount of more than 0 wt % and not more than 0.015 wt % based on the total weight of the steel slab. When phosphorus is contained in an amount within the above-described range, the toughness of the steel may be prevented from decreasing. When phosphorus is contained in an amount of more than 0.015 wt %, it may cause cracking during the process and form an iron phosphide compound that may degrade the toughness of the steel.

Sulfur (S)

Sulfur (S) is an element that degrades workability and physical properties. In one embodiment, sulfur may be contained in an amount of more than 0 wt % and not more than 0.005 wt % based on the total weight of the steel slab. When sulfur is contained in an amount of more than 0.005 wt %, it may degrade the hot-rolling workability and cause surface defects such as cracks by producing macro-inclusions.

Chromium (Cr)

Chromium (Cr) is included for the purpose of improving the hardenability and strength of the steel. In one embodiment, chromium is contained in an amount of 0.05 to 1.00 wt % based on the total weight of the steel slab. When chromium is contained in an amount of less than 0.05 wt %, the effect of adding chromium may not be properly exhibited, and when chromium is contained in an amount of more than 1.00 wt %, it may degrade the toughness of the steel and increase the production cost.

Boron (B)

Boron (B) is included for the purpose of ensuring the hardenability and strength of the steel by ensuring a martensite structure, and has the effect of refining grains by increasing the growth temperature of austenite grains.

In one embodiment, boron is contained in an amount of 0.001 to 0.009 wt % based on the total weight of the steel slab. When boron is contained in an amount of less than 0.001 wt %, the effect of increasing hardenability may be insufficient, and when boron is contained in an amount of more than 0.009 wt %, the risk of degrading the elongation of steel may increase.

Titanium (Ti)

Titanium (Ti) is included for the purpose of enhancing hardenability and enhancing properties by precipitate formation after the hot-stamping heat treatment. In addition, titanium effectively contributes to austenite grain refinement by forming precipitates such as Ti(C,N) at high temperature.

In one embodiment, titanium is contained in an amount of 0.01 to 0.09 wt % based on the total weight of the steel slab. When titanium is contained in an amount of less than 0.01 wt %, the effect of addition of titanium may be insignificant, and when titanium is contained in an amount of more than 0.09 wt %, failure in continuous casting may occur, it may be difficult to ensure the physical properties of the steel, the elongation of the steel may be decreased, and cracks may occur on the surface of the steel.

Molybdenum (Mo)

Molybdenum (Mo) may contribute to strength improvement by suppressing precipitate coarsening and increasing hardenability during hot rolling and hot stamping. Molybdenum (Mo) may be contained in an amount of 0.01 wt % to 0.80 wt % based on the total weight of the steel plate. When the content of molybdenum (Mo) is less than 0.01 wt %, the effect of addition of molybdenum may not be properly exhibited, and when the content of molybdenum (Mo) is more than 0.80 wt %, a problem may arise in that the cost of the alloy increases, resulting in a decrease in economic efficiency.

Niobium (Nb)

Niobium (Nb) is included for the purpose of increasing strength and toughness by reducing the martensite packet size.

In one embodiment, niobium is contained in an amount of 0.01 wt % to 0.09 wt % based on the total weight of the steel slab. When niobium is contained in an amount of less than 0.01 wt %, the effect of refining grains of the steel in the hot rolling and cold rolling processes may be insignificant, and when niobium is contained in an amount of more than 0.09 wt %, it may form coarse precipitates in the steel making process, degrade the elongation of the steel, and may be disadvantageous in terms of the production cost.

In one embodiment, the steel slab may be heated at a slab reheating temperature (SRT) of 1,200° C. to 1,250° C. At this steel slab reheating temperature, the effect of homogenizing the alloying elements is advantageously achieved. When the steel slab is reheated at a temperature lower than 1,200° C., the effect of homogenizing the alloying elements may be reduced, and when the steel slab is reheated at a temperature higher than 1,250° C., the process cost may increase.

(S20) Hot-Rolling Step

This step is a step of hot-rolling the reheated steel slab. In one embodiment, the hot rolling may be performed by hot-rolling the reheated steel slab at a finish-rolling temperature (FDT) of 880° C. to 950° C. When the hot rolling is performed at this finish-rolling temperature, the effect of homogenizing the alloying elements may be advantageously achieved, and the rigidity and formability of the steel may be excellent.

(S30) Coiling Step

This step is a step of coiling the hot-rolled steel slab to produce a hot-rolled coil. In one embodiment, the hot-rolled steel slab can be coiled at a coiling temperature (CT) of 680° C. to 800° C. In one embodiment, the hot-rolled steel slab may be cooled up to the coiling temperature within the above-described range, and then coiled. At this coiling temperature, redistribution of carbon is easily achieved, and it is possible to secure a sufficient hot-rolled decarburized layer and to prevent distortion of the hot-rolled coil.

In one embodiment, the cooling may be performed using a water-free cooling method that uses no water. When the water-free cooling method is used, a decarburized layer may advantageously be formed by lowering the cooling rate of the hot-rolled coil and increasing the contact time between the surface of the hot-rolled steel plate and oxygen. When the coiling temperature is lower than 680° C., it is difficult to ensure a sufficient hot-rolled decarburized layer, and distortion of the hot-rolled coil may occur. When the coiling temperature is higher than 800° C., deterioration in the formability or strength of the steel may occur due to abnormal grain growth or excessive grain growth.

In one embodiment, the hot-rolled decarburized layer of the coiled hot-rolled coil may be formed to a thickness of 10 to 50 μm from the surface.

(S40) Cold-Rolling Step

This step is a step of uncoiling the hot-rolled coil, followed by cold-rolling to produce a cold-rolled steel plate. In one embodiment, the hot-rolled coil may be uncoiled, and then pickled, followed by cold rolling. The pickling may be performed for the purpose of removing scales formed on the surface of the hot-rolled coil. In one embodiment, the cold rolling may be performed on the pickled hot-rolled steel plate at a cold-rolling reduction ratio of 60-80%. When the cold-rolling reduction ratio is less than 60%, the effect of deforming the hot-rolled structure is insignificant. On the other hand, when the cold-rolling reduction ratio is more than 80%, problems may arise in that the cost required for cold rolling increases, the drawability of the steel decreases, and cracks occur on the edge of the steel plate, resulting in fracture of the steel plate. In the cold-rolling process, the thickness of the hot-rolled decarburized layer may decrease.

(S50) Annealing Step

This step is a step of annealing and plating the cold-rolled steel plate. In one embodiment, the annealing process may be performed at a process temperature of 740° C. to 820° C. In one embodiment, the annealing may be performed at a dew point of −15° C. or below in a gas atmosphere composed of hydrogen and the balance of nitrogen. When the annealing is performed in a gas atmosphere composed of hydrogen and the balance of nitrogen, the occurrence of decarburization during the annealing process may be prevented. Next, the annealed steel plate may be cooled. The cooling may be performed, for example, at a cooling rate of 5 to 50° C./sec.

(S60) Plating Step

After completion of the annealing process, a process of plating the steel plate may be continuously performed. The plating process may be performed by stopping the cooling of the steel plate and immersing the steel plate in a plating bath at a temperature of 650° C. to 660° C. For example, the plating process may be a process of forming an aluminum-silicon (Al—Si) plating layer, and the plating bath may contain molten aluminum and molten silicon.

(S70) Hot-Stamping Step

In the hot-stamping step, the plated steel plate is heated and hot-stamped in a mold having a predetermined shape. The hot-stamping process may be performed by cutting the cold-rolled steel plate to form a blank, and then heating the blank at a temperature of 850° C. to 950° C., followed by hot molding using a press mold.

In one embodiment, after the hot-stamping process, the hot-rolled decarburized layer may have a thickness of 5 to 15 μm from the surface. The hot-rolled decarburized layer may have a microstructure composed of ferrite, bainite and martensite. Due to the ferrite structure of the hot-rolled decarburized layer, the surface brittleness of the hot-stamped part may be alleviated, and improvement in the plasticity, bending performance and crash performance of the hot-stamped part is possible.

Hot-Stamped Part Manufactured by Method for Manufacturing Hot-Stamped Part

Another aspect of the present disclosure relates to a hot-stamped part manufactured by the method for manufacturing a hot-stamped part. In one embodiment, the hot-stamped part may include a steel having a composition including, by wt %, 0.20 to 0.50% carbon (C), 0.05 to 1.00% silicon (Si), 0.10 to 2.50% manganese (Mn), more than 0% and not more than 0.015% phosphorus (P), more than 0% and not more than 0.005% sulfur (S), 0.05 to 1.00% chromium (Cr), 0.001 to 0.009% boron (B), 0.01 to 0.09% titanium (Ti), and the balance of iron (Fe) and inevitable impurities, have a surface decarburized layer formed to a thickness of 5 to 15 μm from the surface of the steel, and have a tensile strength (TS) of 1,400 MPa or greater, a yield strength (YS) of 1,000 MPa or greater, and an elongation (EL) of 7% or greater.

The components and contents thereof in the hot-stamped part are the same as the components contained in the steel slab, and thus the detailed description thereof will be omitted. The surface decarburized layer may result from the hot-rolled decarburized layer formed after the hot-rolling process.

In one embodiment, the microstructure of the surface decarburized layer present in the hot-stamped part may be composed of ferrite, bainite and martensite. At this time, due to the ferrite structure of the surface decarburized layer, the surface brittleness of the hot-stamped part may be alleviated, and improvement in the plasticity, bending performance and crash performance of the hot-stamped part is possible.

Examples

Hereinafter, the configuration and effects of the present disclosure will be described in more detail with reference to preferred examples. However, these examples are presented as preferred examples of the present disclosure and cannot be construed as limiting the present invention in any way.

A steel slab containing the components shown in Table 1 below, which satisfy the composition range of the embodiment of the present disclosure, and the balance of iron (Fe) and inevitable impurities, was reheated at a temperature of 1,200° C., and then subjected to a hot-rolling process according to the process conditions shown in Table 2 below, thereby preparing specimens of Comparative Examples 1 to 4 and Examples 1 to 4. More specifically, Comparative Examples 1 to 4 were prepared using a water-based cooling method under the following process conditions: a finish-rolling temperature (FDT) of 884° C. to 889° C., and a coiling temperature of (CT) of 555° C. to 643° C. That is, after finish rolling, cooling of the hot-rolled steel plate was performed by spraying water in the cooling process reaching the coiling temperature. Examples 1 to 4 were prepared using a water-free cooling method under the following process conditions: a finish-rolling temperature (FDT) of 885° C. to 927° C., and a coiling temperature (CT) of 682° C. to 797° C. That is, after finish rolling, cooling of the hot-rolled steel plate was performed without supplying water in the cooling process reaching the coiling temperature. Finally, the specimens of Comparative Examples 1 to 4 and Examples 1 to 4 were prepared.

In addition, on the hot-rolled specimens of Comparative Examples 1 to 4 and Examples 1 to 4, cold rolling was performed, and then annealing heat treatment was performed at a temperature of 765° C., followed by cooling at a rate of 33° C./s. During the cooling, a process of forming an aluminum-silicon (Al—Si) plating layer was performed by immersing each steel plate in a plating bath containing molten aluminum and molten silicon at a temperature of 660° C. The annealing treatment was performed at a dew point of −15° C. or below in a gas atmosphere composed of hydrogen and the balance of nitrogen.

In addition, the specimens of Comparative Examples 1 to 4 and Examples 1 to 4, on which the plating layer was formed, were heated at a temperature of 930° C. for 5 minutes, and then each of the heated steel plates was transferred to a hot-press mold within a transfer time of about 10 seconds, subjected to hot-press molding, thereby preparing molded articles. The molded articles were cooled at a cooling rate of 75° C./s, thereby manufacturing hot-stamped parts.

TABLE 1

| Components (wt %) | | | | | | | |
|---|---|---|---|---|---|---|---|
| C | Si | Mn | S | P | Cr | B | Ti |
| 0.23 | 0.25 | 1.25 | 0.003 | 0.011 | 0.21 | 0.0031 | 0.030 |

TABLE 2

| Classification | Cooling method | Finish-rolling temperature (° C.) | Coiling temperature (° C.) |
|---|---|---|---|
| Comparative Example 1 | Using water | 889 | 555 |
| Comparative Example 2 | Using water | 884 | 562 |
| Comparative Example 3 | Using water | 886 | 605 |
| Comparative | Using water | 885 | 643 |

TABLE 2-continued

| Classification | Cooling method | Finish-rolling temperature (° C.) | Coiling temperature (° C.) |
|---|---|---|---|
| Example 4 | | | |
| Example 1 | Without using water | 885 | 682 |
| Example 2 | Without using water | 885 | 720 |
| Example 3 | Without using water | 927 | 797 |
| Example 4 | Without using water | 917 | 760 |

For the specimens of Comparative Examples 1 to 4 and Examples 1 to 4, the grain size and hot-rolled decarburized layer thickness of each of the hot-rolled steel plates were measured before the cold-rolling process after the hot-rolling process. In addition, for the specimens of Comparative Examples 1 to 4 and Examples 1 to 4, whether or not distortion defects of each coil would occur was observed before the cold-rolling process after the hot-rolling process. Moreover, for the specimens of Comparative Examples 1 to 4 and Examples 1 to 4, the microstructure fraction was measured after completion of the hot-stamping process. The measurement was performed using a known ASTM E562-11 systematic manual point count method. For each of the specimens of Comparative Examples 1 to 4 and Examples 1 to 4, ten images of 500 μm×500 μm were taken, and the area fractions of the microstructures were measured therefrom. The average value of the measured area fractions for each specimen is shown in Table 3 below.

Referring to Table 3 below, it can be seen that, when comparing Examples 1 to 4 with Comparative Examples 1 to 4, Examples 1 to 4 have grain sizes similar to those of Comparative Examples 1 to 4, but Examples 1 to 4 have relatively thicker hot-rolled decarburized layers. In the case of Comparative Examples 1 to 4, coil distortion defects occurred after the hot-rolling process, but in the case of Examples 1 to 4, no coil distortion defect occurred.

TABLE 3

| | Observation after hot-rolling process | | | Observation after plating process | Observation after hot-stamping process | | |
|---|---|---|---|---|---|---|---|
| Classification | Whether or not coil distortion defects after hot-rolling process would occur | Grain size (μm) | Hot-rolled decarburized layer (μm) | Decarburized layer (μm) remaining after plating process | Ferrite area fraction (%) | Bainite area fraction (%) | Martensite area fraction (%) |
| Comparative Example 1 | Occurred | 17 | 2-3 | 0 | 7.5% | 17.5% | 75% |
| Comparative Example 2 | Occurred | 18 | 3-4 | 0 | 6.5% | 15.5% | 78% |
| Comparative Example 3 | Occurred | 18 | 3-4 | 0 | 7% | 16.5% | 76.5% |
| Comparative Example 4 | Occurred | 18 | 4-5 | 0 | 7.5% | 17% | 75.5% |
| Example 1 | Did not occur | 18 | 8-12 | 2-4 | 10.5% | 17% | 72.5% |
| Example 2 | Did not occur | 18 | 12-18 | 4-6 | 13.5% | 19% | 67.5% |
| Example 3 | Did not occur | 19 | 18-34 | 6-11 | 16% | 21% | 63% |
| Example 4 | Did not occur | 18 | 15-24 | 5-8 | 15% | 21.5% | 63.5% |

The results of observation after the cold rolling, annealing and plating processes indicated that a decrease in the thickness of the hot-rolled decarburized layer in each specimen of Comparative Examples 1 to 4 and Example 1 to 4 did occur. It is considered that the thickness of the hot-rolled steel plate was decreased by the cold rolling, and thus the thickness of the hot-rolled decarburized layer also decreased. In the case of the specimens of Comparative Examples 1 to 4, it was observed that the hot-rolled decarburized layer remained with a very small thickness after the cold rolling, annealing and plating processes were sequentially performed. On the other hand, after completion of the cold rolling, annealing and plating processes, a residual decarburized layer having a thickness of 2 to 11 μm was observed in the specimens of Examples 1 to 4.

After the hot stamping, the prepared specimens of Comparative Examples 1 to 4 and Examples 1 to 4 could have a mixed structure of ferrite, bainite and martensite. The area fraction of ferrite in the specimens of Examples 1 to 4 was relatively higher than that in Comparative Examples 1 to 4, and the area fraction of martensite in the specimens of Examples 1 to 4 was relatively low.

Meanwhile, the manufactured hot-stamped parts of Comparative Examples 1 to 4 and Examples 1 to 4 satisfied all the following desired mechanism properties: a tensile strength (TS) of 1,400 MPa or greater, a yield strength (YS) of 1,000 MPa or greater, and an elongation (EL) of 7% or greater.

Figure 2:
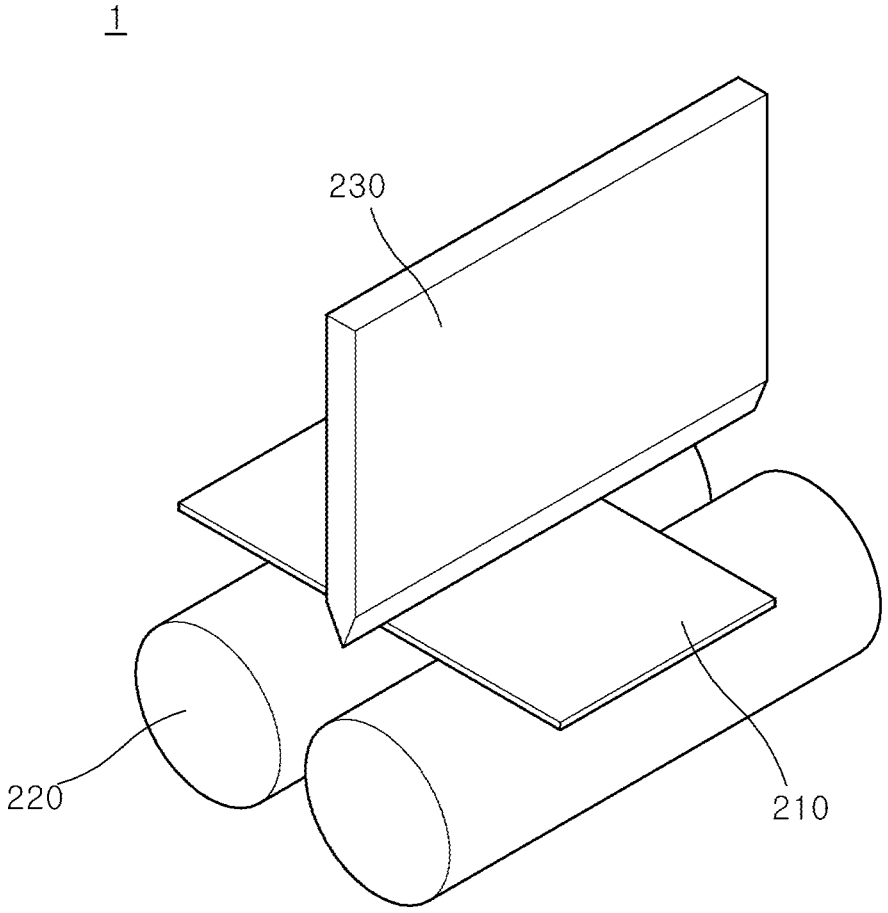
FIG. 2 shows an apparatus for performing a crash simulation test for the steel of the present disclosure.

In addition, for the hot-stamped parts of Comparative Examples 1 to 4 and Examples 1 to 4, a crash simulation test was performed. FIG. 2 shows an apparatus for performing a crash simulation test for the steel of the present disclosure. For each of Examples 1 to 4 and Comparative Examples 1 to 4, a specimen 210 having a length of 30 mm and a width of 60 mm was prepared and disposed on a pair of rolls 220 having a radius of 15 mm and laterally spaced apart from each other at a predetermined distance. The lateral spacing may be proportional to the thickness of the specimen 210, for example. As an example, the lateral spacing of the pair of rolls 220 may be set to a value of 0.5 mm plus twice the thickness of the specimen 210. Subsequently, using a test apparatus 1 shown in FIG. 2, a crash simulation test was performed in which deformation and fracture were measured while the specimen 210 of each of Examples 1 to 4 and Comparative Examples 1 to 4 was pressed by applying a load thereto with a bending punch 230 having a punch radius of 0.4 mm at one end thereof. The results are shown in Table 4 below.

TABLE 4

| Classification | Crash performance simulation (mold cooling material) | | | |
|---|---|---|---|---|
| | Load (kN) | Displacement (mm) | Bending angle (°) | Energy (J) |
| Comparative Example 1 | 7.9 | 7.1 | 61.6 | 53.8 |
| Comparative Example 2 | 7.9 | 6.9 | 59.6 | 51.8 |
| Comparative Example 3 | 7.9 | 7.1 | 60.9 | 52.6 |
| Comparative Example 4 | 7.9 | 7.1 | 60.5 | 52.3 |
| Example 1 | 7.9 | 7.3 | 63.8 | 56.1 |
| Example 2 | 8.1 | 7.8 | 68.7 | 58.5 |
| Example 3 | 8.1 | 7.5 | 62.6 | 57.8 |
| Example 4 | 8.1 | 7.6 | 63.2 | 56.3 |

As can be seen in Tables 3 and 4 above, when comparing Examples 1 to 4 with Comparative Examples 1 to 4, Examples 1 to 4 having a relatively thick surface decarburized layer showed relatively good values in terms of the values of load, displacement, bending angle and bending energy, compared to Comparative Examples 1 to 4, and particularly, showed an improvement in crash performance of about 10% or greater in terms of energy.

Test for Observation of Cross-Sectional Structure

Figure 3A:
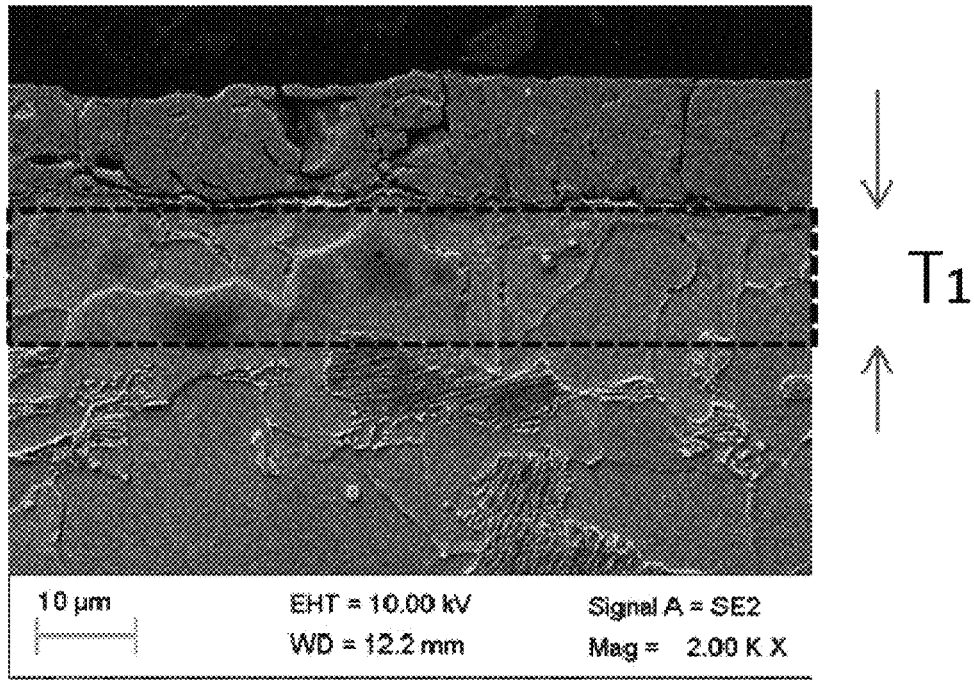
FIGS. 3A to 3C show the results of observing changes in the cross-sectional structure of a decarburized layer following the hot-rolling process, cold-rolling process and hot-stamping process according to one embodiment of the present disclosure.
Figure 3B:
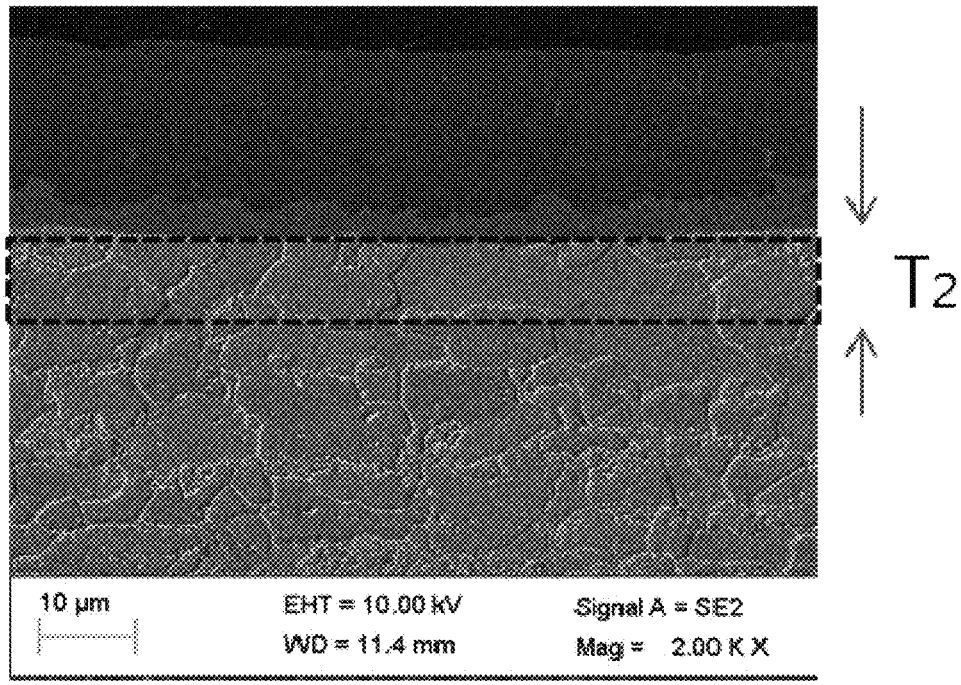
Figure 3C:
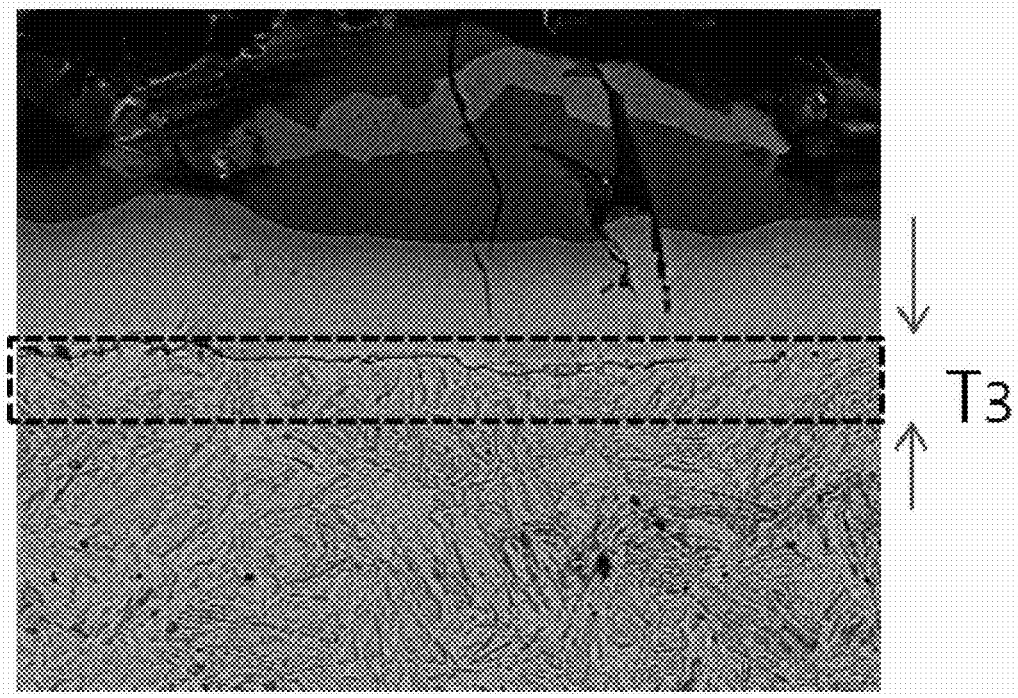
Figure 4A:
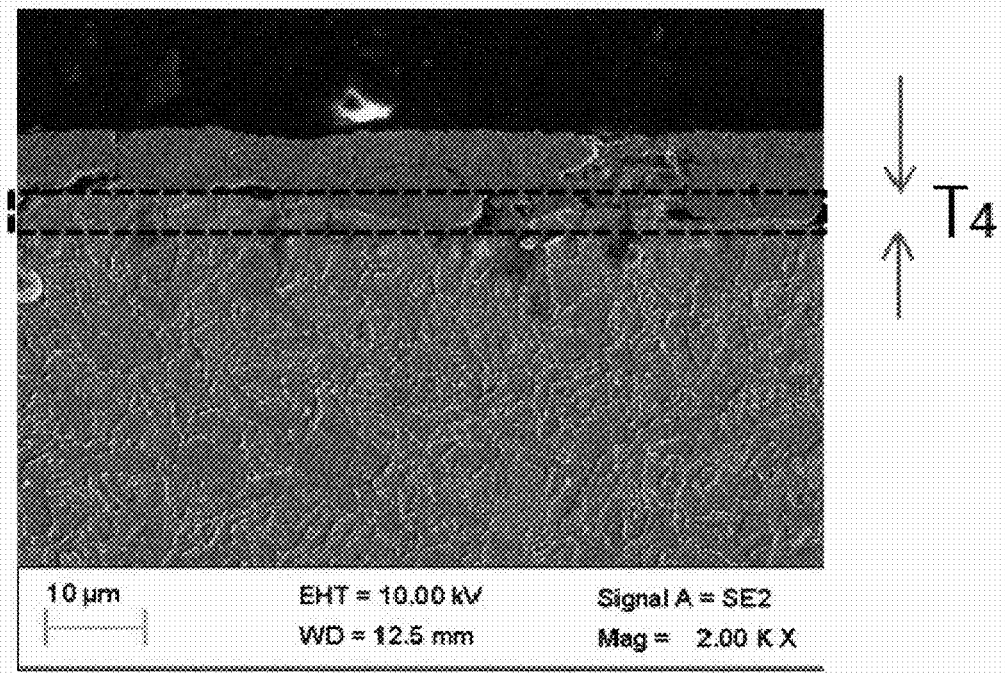
FIGS. 4A to 4C show the results of observing changes in the cross-sectional structure of a decarburized layer following the hot-rolling process, cold-rolling process and hot-stamping process of a comparative embodiment for the present disclosure.
Figure 4B:
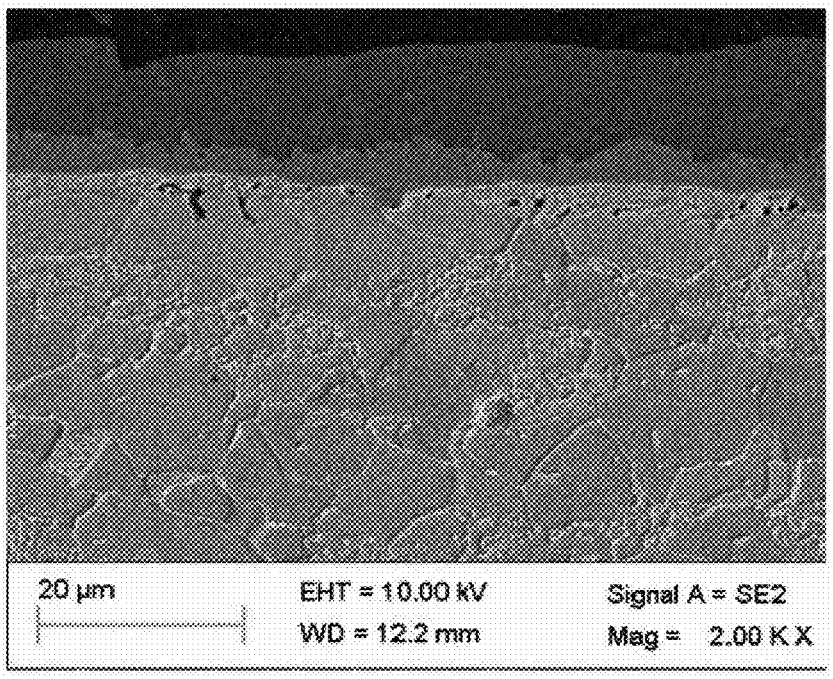
Figure 4C:
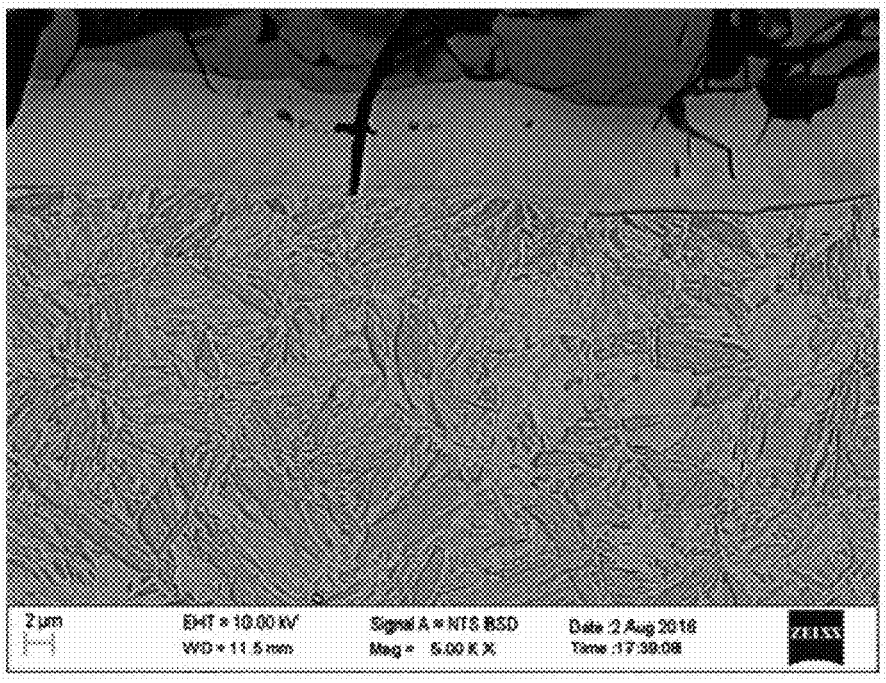

FIGS. 3A to 3C show the results of observing changes in the sectional structure of the decarburized layer following the hot-rolling process, cold-rolling process and hot-stamping process according to one embodiment of the present disclosure. FIGS. 4A to 4C show the results of observing changes in the cross-sectional structure of the decarburized layer following to the hot-rolling process, cold-rolling process and hot-stamping process of a comparative embodiment for the present disclosure.

As an embodiment, FIG. 3A is a cross-sectional image obtained after subjecting a steel slab, having the composition shown in Table 1 above, to a hot-rolling process by finish-hot-rolling at a temperature of 920° C., cooling without using water, and coiling at a coiling temperature of 755° C. As can be seen therein, a hot-rolled decarburized layer having a thickness ($T_1$) of 13 μm was observed in the hot-rolled steel plate. FIG. 3B is a cross-sectional image obtained after additionally performing a cold-rolling process, an annealing process at a temperature of 765° C. and an aluminum-silicon plating layer formation process at a temperature of 660° C. As can be seen therein, a hot-rolled decarburized layer having a thickness ($T_2$) of 6 μm was observed in the cold-rolled steel plate. FIG. 3C is a cross-sectional image obtained after additionally performing hot-stamping treatment. As can be seen therein, a hot-rolled decarburized layer having a thickness ($T_3$) of 6 μm was observed in the hot-stamped part.

As a comparative embodiment, FIG. 4A is a cross-sectional image obtained after subjecting a steel slab, having the composition shown in Table 1 above, to a hot-rolling process by finish-hot-rolling at a temperature of 880° C., cooling using water, and coiling at a coiling temperature of 600° C. As can be seen therein, a hot-rolled decarburized layer having a thickness ($T_4$) of 3 μm was observed in the hot-rolled steel plate. FIG. 4B is a cross-sectional image obtained after additionally performing a cold-rolling process, an annealing process at a temperature of 765° C. and an aluminum-silicon plating layer formation process at a temperature of 660° C. As can be seen therein, a hot-rolled decarburized layer having a very small thickness was observed in the cold-rolled steel plate. FIG. 4C is a cross-sectional image obtained after additionally performing hot-stamping treatment. As can be seen therein, a hot-rolled decarburized layer having a very small thickness was observed in the hot-stamped part after the hot-stamping treatment.

Figure 5:
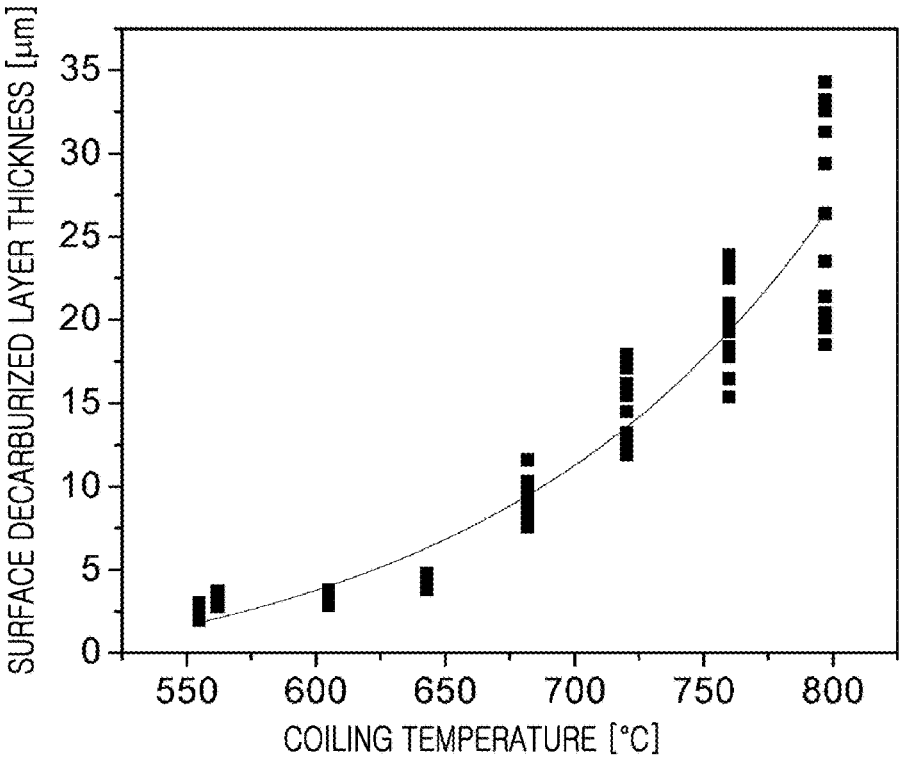
FIG. 5 is a graph showing the correlation between the thickness of a hot-rolled decarburized layer and the coiling temperature according to one embodiment of the present disclosure.

FIG. 5 is a graph showing the correlation between the thickness of a hot-rolled decarburized layer and the coiling temperature according to one embodiment of the present disclosure. FIG. 5 is a distribution chart obtained by measuring the thickness of a decarburized layer after the hot-rolling process for a total of 78 specimens in Comparative Examples 1 to 4 and Examples 1 to 4 described above, and plotting the measured thickness as a function of the coiling temperature. Then, regression analysis was performed on the distribution chart of FIG. 5 to obtain the following relational expression:

$$T=-3.015+0.078*e(0.0075*CT)$$

CT: coiling temperature (° C.), T: thickness (μm) of hot-rolled decarburized layer.

Referring to FIG. 5, it can be confirmed that as the coiling temperature increases, the thickness of the hot-rolled decarburized layer increases exponentially.

Figure 6:
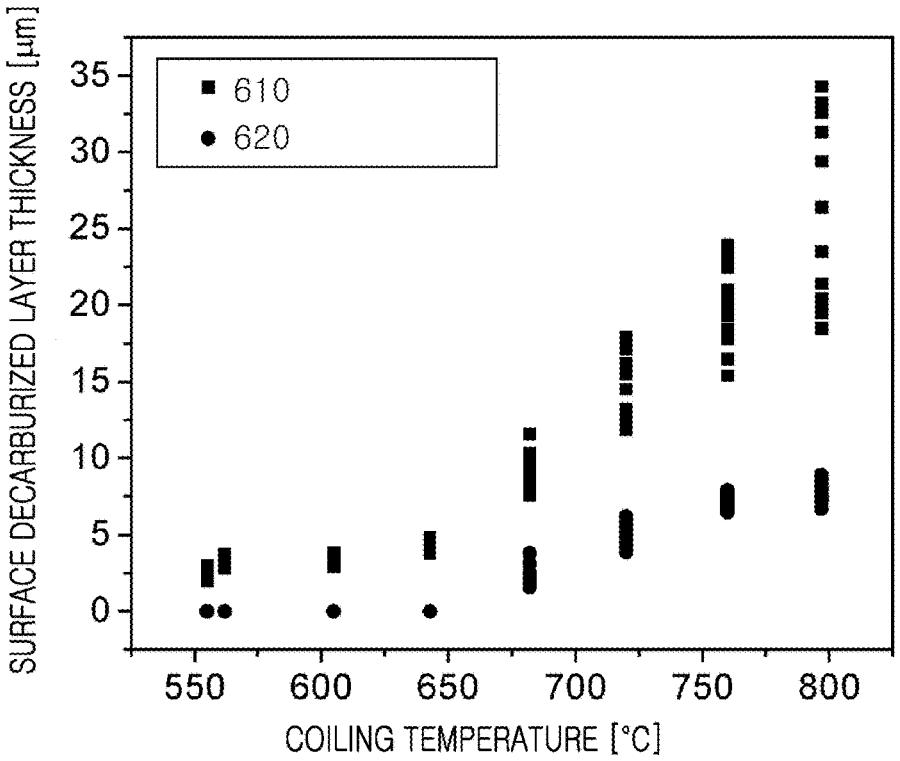
FIG. 6 is a graph showing the changes in the thickness of a decarburized layer after a hot-rolling process and a cold-rolling process as a function of the coiling temperature according to an embodiment of the present disclosure.

FIG. 6 is a distribution chart showing the changes in the thickness of a decarburized layer after a hot-rolling process and a cold-rolling process as a function of the coiling temperature according to one embodiment of the present disclosure. Referring to FIG. 6, a first distribution chart 610 is identical to the distribution chart of FIG. 5. A second distribution chart 620 is a graph showing a decarburized layer remaining in the steel as a function of the hot rolling/coiling temperature after additionally performing a cold-rolling process, an annealing process at a temperature of 765° C. and an aluminum-silicon plating layer formation process at a temperature of 660° C. on each of the hot-rolled specimens of Comparative Examples 1 to 4 and Examples 1 to 4, from which the first distribution chart 610 was obtained.

Referring to FIG. 6, it can be confirmed that in the case in which the coiling temperature during the hot-rolling process was lower than 680° C., when the cold-rolling process, the annealing process and the plating process were performed, the thickness of the hot-rolled decarburized layer was reduced to a very small thickness. Accordingly, it may be difficult to ensure the effect of improving the crash performance of the hot-stamped product by the remaining hot-rolled decarburized layer.

It is to be understood that the present disclosure encompasses not only the disclosed embodiments, but also various modifications and equivalent other embodiments that can be derived by those skilled in the art from the disclosed embodiments. Therefore, the technical protection scope of the present invention shall be defined by the following claims.

The invention claimed is:

1. A method for manufacturing a hot-stamped part, comprising the steps of:

(a) reheating a steel slab at a temperature of 1,200° C. to 1,250° C., the steel slab comprising, by wt %, 0.20 to 0.50% carbon (C), 0.05 to 1.00% silicon (Si), 0.10 to 2.50% manganese (Mn), more than 0% and not more than 0.015% phosphorus (P), more than 0% and not more than 0.005% sulfur (S), 0.05 to 1.00% chromium (Cr), 0.001 to 0.009% boron (B), 0.01 to 0.09% titanium (Ti), and a balance of iron (Fe) and inevitable impurities;

(b) finish-rolling the reheated steel slab at a temperature of 880° C. to 950° C.;

(c) cooling the hot-rolled steel slab without using water, and coiling the cooled steel slab at a temperature of 680° C. to 800° C. to form a hot-rolled decarburized layer on a surface of the steel slab;

(d) pickling the coiled steel slab, followed by cold rolling;

(e) annealing the cold-rolled steel slab in a reducing atmosphere;

(f) plating the annealed steel slab; and (g) hot-stamping the plated steel slab, wherein the hot-rolled decarburized layer has a thickness of 5 to 15 μm from the surface after the step (g), wherein the hot-rolled decarburized layer comprises a microstructure comprising ferrite and an area fraction of the ferrite ranges from 10.5% to 16%.

2. The method of claim 1, wherein the slab further comprises one or more of 0.01 to 0.80 wt % molybdenum (Mo) and 0.01 to 0.09 wt % niobium (Nb).

3. The method of claim 1, wherein the hot-rolled decarburized layer is formed to have a thickness of 10 to 50 μm from the surface in the step (c).

4. The method of claim 1, wherein the microstructure of the hot-rolled decarburized layer further comprises bainite and martensite after the step (g).

5. The method of claim 1, wherein the annealing in the step (e) is performed at a dew point of −15° C. or below in a gas atmosphere composed of hydrogen and a balance of nitrogen.

6. A hot-stamped part comprising a steel having a composition comprising, by wt %, 0.20 to 0.50% carbon (C), 0.05 to 1.00% silicon (Si), 0.10 to 2.50% manganese (Mn), more than 0% and not more than 0.015% phosphorus (P), more than 0% and not more than 0.005% sulfur (S), 0.05 to 1.00% chromium (Cr), 0.001 to 0.009% boron (B), 0.01 to 0.09% titanium (Ti), and the balance of iron (Fe) and inevitable impurities, the hot-stamped part having a surface decarburized layer formed to have a thickness of 5 to 15 μm from a surface of the steel, and having a tensile strength (TS) of 1,400 MPa or greater, a yield strength (YS) of 1,000 MPa or greater, and an elongation (EL) of 7% or greater, wherein the surface decarburized layer comprises a microstructure formed on the surface of the decarburized layer and comprising ferrite, and wherein an area fraction of the ferrite ranges from 10.5% to 16%.

7. The hot-stamped part of claim 6, wherein the microstructure of the surface decarburized layer further comprises bainite and martensite.

* * * * *